US007374209B2

(12) United States Patent
von Detten

(10) Patent No.: US 7,374,209 B2
(45) Date of Patent: May 20, 2008

(54) ICE SKATE WITH ELASTIC SUSPENSION

(76) Inventor: Volker von Detten, 535 E. Walnut Ave., Apt. A, El Segundo, CA (US) 90245

( * ) Notice: Subject to any disclaimer, the term of this patent is extended or adjusted under 35 U.S.C. 154(b) by 150 days.

(21) Appl. No.: 11/391,803

(22) Filed: Mar. 29, 2006

(65) Prior Publication Data

US 2008/0012248 A1 Jan. 17, 2008

Related U.S. Application Data

(60) Provisional application No. 60/666,275, filed on Mar. 29, 2005.

(51) Int. Cl.
*A63C 1/00* (2006.01)
*A63C 1/24* (2006.01)
*A63C 17/00* (2006.01)

(52) U.S. Cl. ..... 280/841; 280/11.115; 280/11.2; 280/11.18; 280/11.221; 280/11.225; 280/11.27; 280/11.28; 280/11.12; 280/11.14

(58) Field of Classification Search ..... 280/841, 280/11.115, 11.12, 11.14, 11.221, 11.2, 11.18, 280/11.225, 11.27, 11.28
See application file for complete search history.

(56) References Cited

U.S. PATENT DOCUMENTS 5,931,480 A 8/1999 Schroeder
6,454,279 B1 * 9/2002 Yang ..... 280/11.223
6,631,911 B2 * 10/2003 Chen et al. ..... 280/11.223
2002/0070513 A1 * 6/2002 Chang ..... 280/11.221
2003/0001347 A1 * 1/2003 Chen et al. ..... 280/11.221
2003/0030237 A1 * 2/2003 Lo et al. ..... 280/11.28

* cited by examiner

*Primary Examiner*—Christopher Ellis
*Assistant Examiner*—John R Olszewski
(74) *Attorney, Agent, or Firm*—Gene Scott Patent Law & Venture Group

(57) ABSTRACT

An ice skate comprises a horizontal platform and a pair of opposing side brackets perpendicularly secured to an underside of the platform. A pair of opposing extension arms is pivotally engaged with each end portion of the side brackets, and an extender bracket is engaged with a center portion of the side brackets. Each extension arm has a torsion spring confined and arranged to enable the extension arm to pivot about the center axle within a certain range in tandem with the other of the pair of extension arms. A distal end of each extension arm has an axle non-rotatably engaged with a follower rotatably engaged in a vertical plane. Each follower is engaged with a horizontally elongated hole at front and rear end portions of the skating blade, and the extender bracket provides an additional follower engaged with a vertically elongated hole on a centerline of the skating blade.

16 Claims, 6 Drawing Sheets

ICE SKATE WITH ELASTIC SUSPENSION

RELATED APPLICATIONS

This application claims the priority date of prior filed applications having Ser. No. 60/666,275 and filing date of Mar. 29, 2005 and entitled: Ice skate with flexible and shock absorbent blade mount.

INCORPORATION BY REFERENCE

Applicant(s) herein incorporate by reference, any and all U.S. patents and U.S. patent applications cited or referred to in this application.

BACKGROUND OF THE INVENTION

1. Field of Invention

This invention relates generally to ice skates in particular to an ice skate including the arrangement of elements to provide a shock absorbent suspension mechanism to enable the ice skate to be used on irregular riding surfaces and for acrobatic type of riding mode including but not limited to jumping and the like by an ice skating passenger.

2. Background

A common ice skate comprises a top platform with the sole of a boot secured to it for a foot of an ice skater. An underside of the top platform provides support brackets affixed along a longitudinal centerline thereof having a skating blade rigidly connected in a vertical plane. The skate itself is well known in the field of ice skates and exists in many configurations and sizes. The type of suspension used in the common skating blade does not include an elastic element for shock absorbency to cushion leg of the skater during skating action especially when jumping. A great number of ice skaters are motivated to perform long jumping or maneuvers which requires a great deal of physical effort by the ice skater to get airborne, and consequentially requiring appropriate leg action to provide for a cushioned landing to prevent injury to the bracing feet and legs. The rigid type of skating blade suspension requires a considerable amount of skill, practice, and physical effort for the ice skater to perform acrobatics of the type described.

3. Description of Related Art

U.S. Pat. No. 5,931,480 describes a foot gear suspension device with a movable swing arm at a front end with a non-rotating axis mounted to distal ends of said swing arm having a free rotating follower bearing guided in an elongated hole of a skating blade along the horizontal plane. The opposite end of said swing arm is pivotally attached to a frame-work of said foot gear having a secondary pivot pin in line with said pivotal attachment connecting to a linear elastic element such as an air, hydraulic, or spring cushioned piston or the like. The distance between said pivot pins determines the degree of leverage and such articulated movement in the vertical plane of said swing arm. A rear end of said suspension device has another swing arm suspended from the framework in an identical arrangement. Said swing distal end is pivotally attached to the skating blade. During skating, the weight of the skater is applied to said foot board in combination with the skating action of pushing the skate against the skating surface, effectings said swing arm to deflect down-wardly in an articulated movement and, upon recoil of the elastic element, assists the ice skater towards enhanced acceleration in forward motion. Arrangement of said swing arm may afford a shock absorbency to the leg of the skater during skating activity especially when running against protrusions in the skating surface or maneuvering around obstacles. The type of fixation of said swing arm provides sufficient clearance to said framework of said footgear during articulated movement of said swing arm. Hence forth it appears this invention teaches optimization of movement in a vertical plane of said swing arm having said skating blade therefore providing sufficient capability for the skater to perform jumps, negotiate obstacles and the like. Said invention among others does not teach how the elasticity of said swing arm is translating a proportional equal or nearly equal force of rebound through-out the complete range of pivotal and articulated travel of said swing arm. Specifically this invention does not explain sufficiently the relationship of the type of elastic element the like of air, hydraulic, spring and other referenced herein and how these elements are connected to and interface with said primary and said secondary pivotal arrangement of said swing arm. The present arrangement as shown and as specified in this invention may not make provisions for optimized utilization of vertical movement of said swing arm and may distribute a disproportional force of rebound in relation to the position of said swing arm and along a total travel range thereof. In retrospect the skating may be very limited resulting in diminished effectiveness for jumping, acrobatics, negotiation of obstacles, surface irregularities and the like. This is manifested by a progressive change in elasticity or rebound force, requiring the ice skater to compensate with proper leg action, balancing and physical strength. Therefore it may be highly likely that a diminished rebound force is assisting the ice skater wherein greater force may be required and in retrospect a greater force may be delivered when a smaller force for rebound may be sufficient. Limitations in the ability of ice skater to use rebound assistance for acceleration in forward motion and performing jumps, acrobatics or negotiating skating surface obstacles or the like may greatly increase the need of ice skaters skill level and physical strength and may render a marginal skating stability at best. Said invention also fails to teach proper fixation of said swing arm arrangement along the horizontal center axis of said pivot arrangement. Because of distal length from said pivot arrangement to said pivotal arrangement and follower respectively of said swing arm lateral forces or thrust applied to said swing arm by ice skater are of considerable force requiring a positive fixation to said swing arm along longitudinal center axis of skating blade and frame work respectively the like of wear plates straddling said swing arm in contiguous mode rather depending solely on said swing arm pivotal arrangement. This may contribute to a greatly diminished level of ice skating stability and safety which is of significant importance when negotiating sharp turns, steeply banked corner riding, quick stops and the like. It is of great attraction to an ice skater and of great incentive to acquire the necessary skills and perform acrobatic type ice-skating. Therefore an ice skater applies on a very frequent basis significant thrust onto said foot gear suspension requiring a considerably contained ice skating blade suspension delivering a superior grasp of the ice skating blade upon the skating surface. The arrangement of said swing arm of this invention in combination with the distal length between the pivot axle and follower bearing axle respectively and pivot point of said swing arm excluding a means of proper containment of said swing arm along the horizontal axis, the wear plate and other fixation elements may not contribute to a desired skating stability for the ice skater and may limit signicantly skating flexibility and safety. For further consideration this invention fails to teach that said ice skating blade remains stationary along a longitudinal axis. Said pivotal arrangement which connects the rear portion of said skating blade with the distal end of said swing arm will move skating blade in reciprocating fashion along the longitudinal axis during articulation of said swing arm. This may prove to be very undesirable to the ice skater's ability to negotiate jumps and save landings after completion of said jumps in a safe and calculated manner. This is of considerable consequence to the safety and skating ability for a skater due to the fact that that the forced longitudinal travel of said skating blade is caused by said pivotal suspension of said swing arm to the rear portion of the ice skating blade and therefore may not provide the ice skater a permanent reference point of said skating blade when performing jumps and other like acrobatic ice skating maneuvers. Furthermore said invention does not teach having said skating blade contained and arrested laterally along the horizontal axis. It is of great importance to an ice skater that said skating blade must not tilt along the vertical plane and be fully contained along the horizontal plane. This is of greater significance when acrobatic ice skating is performed due to the fact that a landing is solely guaranteed only if said skating blade is rigidly connected to said chassis of said foot gear. Any slight movement, wobble or other instability of said skating blade during acrobatic maneuvers, sharp cornering, and jumping may result in falls of the ice skater and may cause injuries, not to mention additional disadvantages such as poor skating control and diminished skating performance.

My prior art search with abstracts described above teaches: several foot gear suspensions including a design, but fail to teach an in line skate with a fixated and unrestricted and shock absorbent skating wheel suspension describing an articulated movement to be of constant deflection force through the complete range of articulated movement without restrictive features to limit articulated movement. The present invention fulfills these needs and provides further related advantages as described in the following summary.

SUMMARY OF INVENTION

The present invention teaches certain benefits in construction and use, which give rise to the objectives described below.

An in-line roller skate comprises a horizontally oriented platform, a pair of opposing side brackets secured to an underside of the platform in a vertical plane, and a pair of extension arms pivotally engaged with the side brackets. Each one of the extension arms has a torsion spring encircling a spacer ring rotationally fixated on a bearing sleeve thereof, which is seated onto a center axle. Each one of the torsion springs is of a multi-coil type made of spring steel or other suitable wire having an extension along the horizontal plane at one extremity of the coil with the like at the opposite extremity thereof and engaged with a hole of each one of the extension arms and side plates respectively. A distal end of each one of the extension arms has an axle fixed in non-rotational fashion with a follower rotationally engaged in a vertical plane. Each one of the torsion springs is confined and arranged to allow each one of the extension arms to rotate on the center axis within a certain range and quadrant of a full circle of which rotation is in tandem whereby the extension arms are engaged with each other and share the follower attached to an axle shaft at a distal end of each one of the extension arms. The follower is engaged with a horizontally-oriented elongated hole in free rotating fashion at a front-end portion and rear end portion respectively of the skating blade. Each one of the side brackets provides an extender bracket with a horizontally-oriented axle having a follower engaged in free rotating fashion with a vertically-oriented elongated hole on a centerline of the skating blade.

A primary objective of one embodiment of the present invention is to provide an apparatus and method of use of such apparatus that yields advantages not taught by the prior art.

A still further objective is to provide a platform for fixating a boot for an ice skate to be used by an ice skater.

A still further objective is to provide an extension arm pivotally engaged with a frame for an ice skate.

A still further objective is to provide an extension arm far an ice skate having an elastic suspension.

A still further objective is to provide an ice skate that is capable of allowing an ice skater to perform acrobatic ice skating maneuvers with relative case.

A still further objective is to provide such an ice skate suspension that encloses all of the elements for safe operation.

A still further objective is to provide such an apparatus that allows the torsion spring to be readily exchangeable with alternate torsion springs to adapt to the weight and desired skating comfort of an ice-skate.

A still further objective is to provide such an apparatus that has easily adjustable extension arms.

A still further objective is to provide such an apparatus that is capable of easily interchanging skating wheels with the skating blade.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

Figure 1:
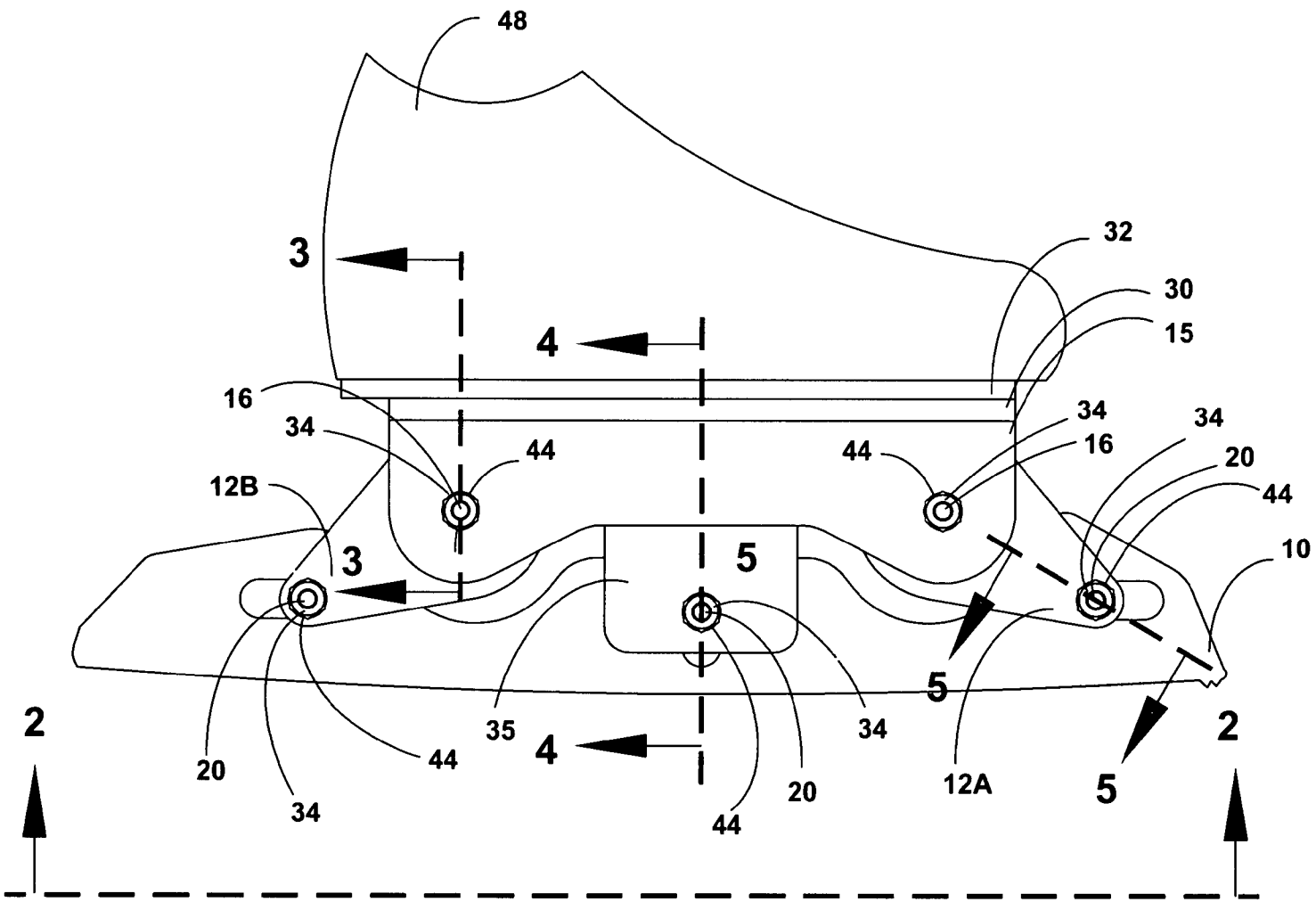
FIG. 1 is a side elevation view of an ice skate embodiment of present invention.
Figure 6:
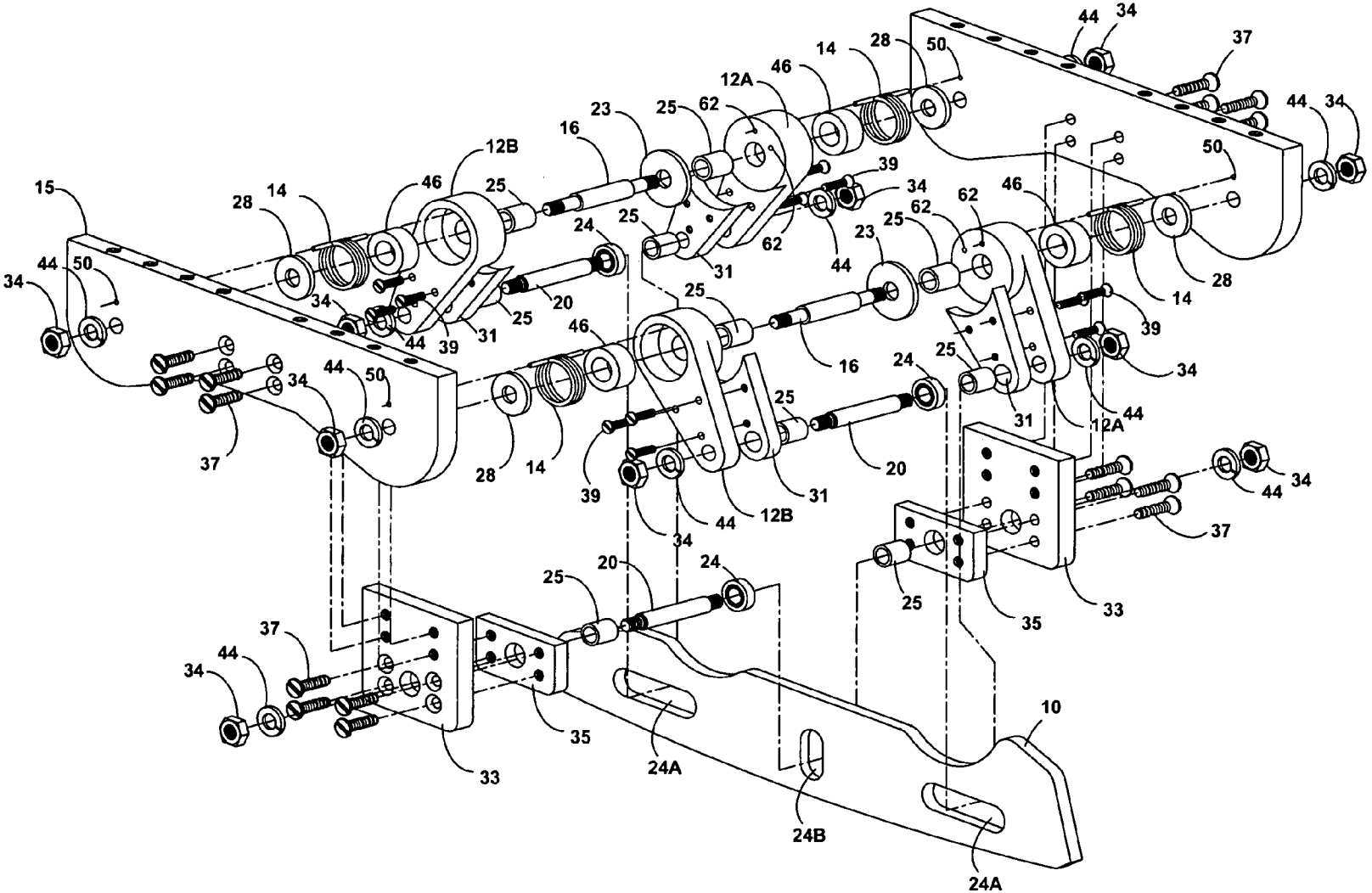
FIG. 6 is an exploded view of an ice skate embodiment of present invention.

FIG. 1 shows an ice skate embodiment of the present invention in front elevation view. A skating boot 48 is secured to a boot support plate 32. A horizontally-oriented platform 30 provides a pair of side brackets 15 perpendicularly positioned with and secured to an underside of the platform 30 with a plurality of counter sink screws 17, as shown in FIG. 6. A plurality of axles 16 haves opposite ends protruding through corresponding holes in each one of the side brackets 15. A lock washer 44 and a nut 34 are each threaded onto each one of the ends of each one of the axles 16, securing each one of the axles 16 in a non-rotating fashion. A pair of opposing extension arms 12A and 12B are provided, each one of the extension arms 12A and 12B pivotally and coaxially engaged with a corresponding axle 16, as shown in FIG. 1. Each one of the extension arms 12A and 12B has a non-rotating axle 20 engaged with a distal end thereof with a lock washer 44 and a nut 34 threaded onto each one of the ends of each one the axles 20. An extender bracket 33 is centrally engaged between side brackets 15 and has a non-rotating axle 20 horizontally secured within a hole in the extender bracket 33, with a lock washer 44 and a nut 34 threaded onto each one of the ends of the axle 20. Skating blade 10 has a plurality of horizontally elongated holes 24A at opposing end portions thereof and a vertically elongated hole 24B on a center axis in vertical plane thereof respectively.

Figure 2:
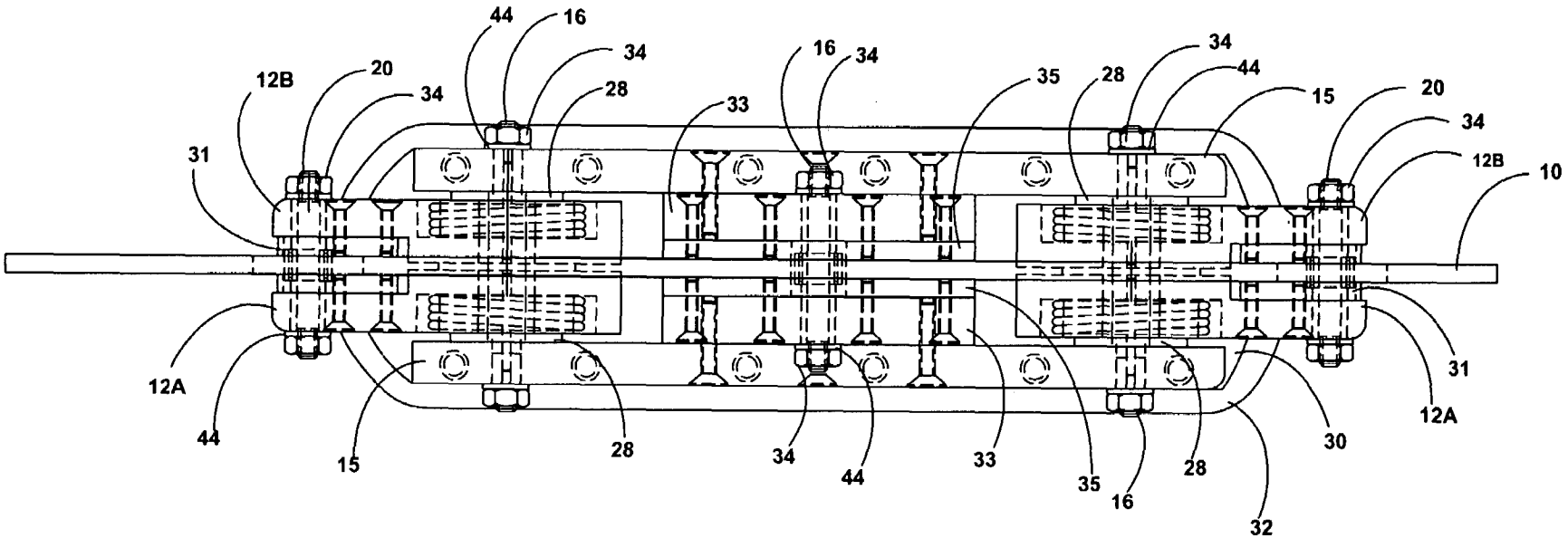
FIG. 2 is a plan view thereof taken along lines 2-2 respectively in FIG. 1.
Figure 3:
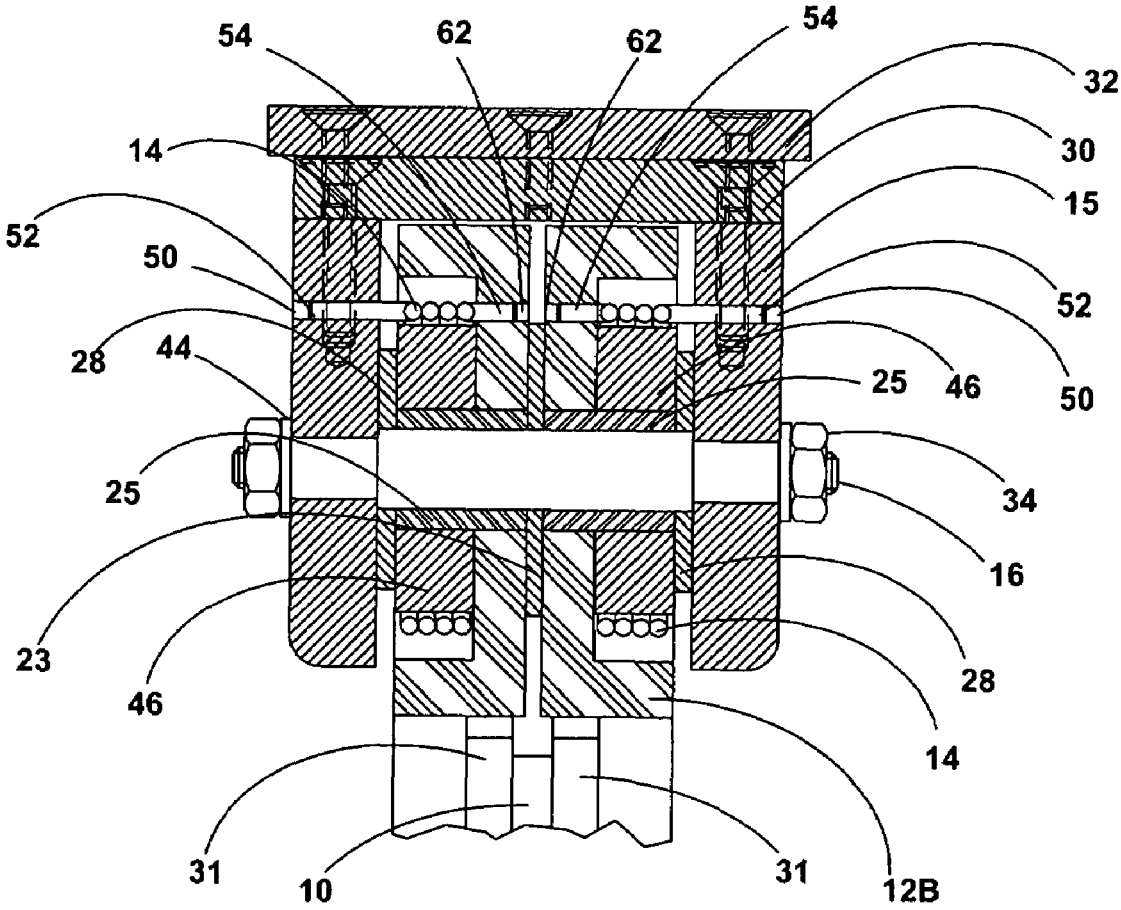
FIG. 3 is a cross sectional view taken along lines 3-3 respectively in FIG. 1.
Figure 5:
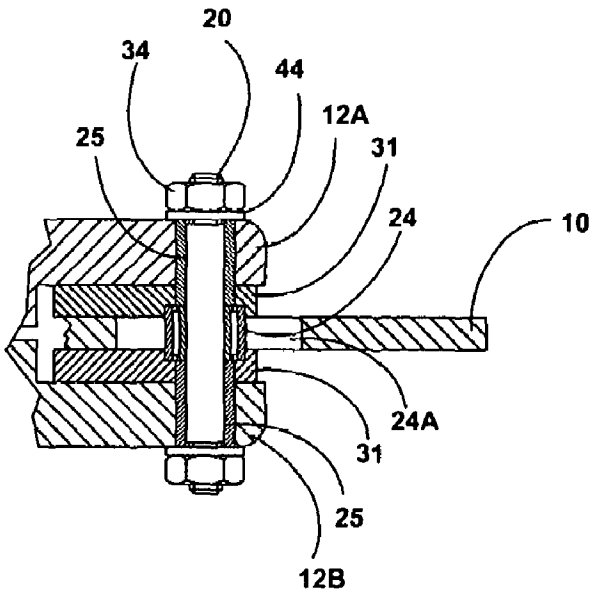
FIG. 5 is a cross sectional view taken along lines 5-5 respectively in FIG. 1.
Figure 4:
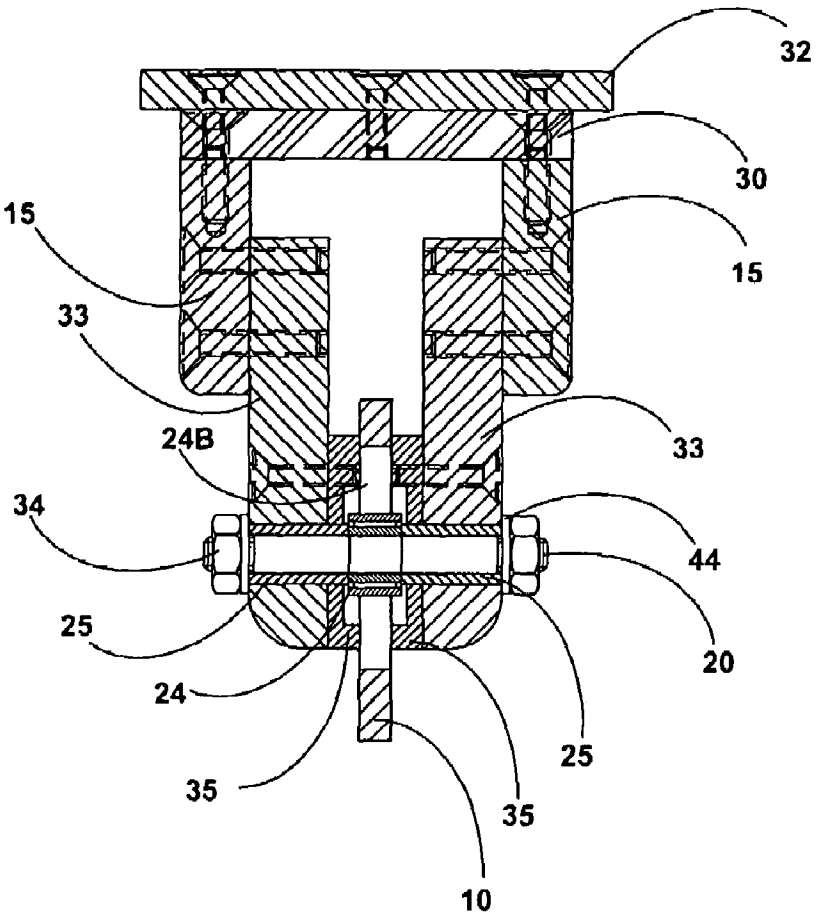
FIG. 4 is a cross sectional view taken along lines 4-4 respectively in FIG. 1.

Proper construction of an ice skate requires that the skating blade 10 is positioned to provide precise alignment along a longitudinal center axis in relation to skating boot 48. This feature is of great importance to the stability and safety of an ice skater. FIG. 2 shows the bottom plan view of an embodiment of this invention. FIGS. 3-5 show respective cross-sectional views of this invention. The side brackets 15 straddle the extension arms 12A and 12B with a plurality of wear spacer rings 23 and 28 rotatably engaged with each one of the axles 16, as shown in FIG. 3. A face of each one of the wear spacer rings 28 is contiguous with each one of the side brackets 15, and an opposing face of each one of the wear spacer rings 28 is contiguous with one of a plurality of spacers 46 as shown in FIG. 3. In addition, each one of the wear spacer rings 23 is contiguous with a hub of one of the extension arms 12A and 12B respectively. One of a pair of extender brackets 33 is centrally affixed to each one of the side brackets 15. One of a plurality of wear spacers 31 is affixed to an opposing face of each one of the extension arms 12A and 12B respectively and contiguous with a vertical face of the skating blade 10. A wear spacer 35 is secured to opposing face of each one of the extender brackets 33 and contiguous with the skating blade 10. A follower 24 is non-rotatably secured to each one of the axles 20, each one of the axles 20 being rotatably engaged within one of the horizontal elongated holes 24A and vertical elongated hole 24B respectively, as shown in FIG. 6. The follower 24 is a cam follower roller bearing which is readily available in many different configurations. As shown in FIG. 6, each one of the wear spacers 31 and 35 is secured to the extension arms 12A and 12B respectively with a counter sink screw 39 and 37 respectively. It is note-worthy to mention that the above described configuration enables the confinement of the extension arms 12A and 12B along a horizontal center axis in a pivotal fashion. Additionally it is easily recognizable that precise alignment for the skating blade 10 along the longitudinal axis is contained such that misalignment and random dislocation thereof during skating action is not possible.

This is due to the precise confinement of the extension arms 12A and 12B along the horizontal center axis and axles 16 respectively. This is high-lighted due to the fact that the overall length of the center portion of axle 16 has a larger circumference than the end portions thereof and of minutely greater linear length, which exceeds the sum of the cross sectional length of the wear spacer rings 28 and 23, spacers 46 and the extension arms 12A and 12B respectively. Therefore, each one of the extension arms 12A and 12B is contained along the horizontal axis of axle 16 and capable of rotational movement thereof during use of this invention. A plurality of sleeve bearings 25 are rotatably engaged with the axles 16 and are sweat fitted with the extension arms 12A and 12B, fixing each one of the bearing sleeves 25 a non-rotatable state. This further provides an effective means to prevent any misalignment thereof during use of this invention by an ice skater while performing sharp cornering, quick stops, and acrobatics. It is noteworthy to mention the importance of the precise confinement of extension arms 12A and 12B respectively by simultaneously providing proper rotational bearing support thereof on the axles 16. A plurality at torsion springs 14 are each encircled by a counter bore of each of the extension arms 12A and 12B respectively and are aligned with the spacers 46. Each one of the torsion springs 14 is made of a wire material of a given hardness, elasticity, cross section, and has a certain number of coils providing a certain spring force to be adequate for the desired torque strength required and to be transmitted to the skating blade 10 via partial rotation of each one of the extension arms 12A and 12B respectively. Each one of the torsion springs 14 has an extension 52 along the horizontal plane at both terminating ends of the coil. As shown in FIG. 3, a plurality of extensions 52 engages with a plurality of through holes 50 and 62 respectively, thus securing the extension arms 12A and 12B in a selected position or home position along the vertical plane depending on location of through hole 62. Preferably, through hole 50 is of elongated configuration along the vertical center axis thereof in order to compensate for diametrical changes of each one of the torsion springs 14 during deflection thereof. In an alternate embodiment to compensate for diametrical change of torsion spring 14, an elongated hole 50 is substituted with a dog point (not shown) urging against a terminal end portion of the coil of each one of the torsion springs 14. As also shown in FIG. 6, each one of the extension arms 12A and 12B has a through hole 62 to enable the Corresponding torsion spring 14 to be installed as described, therefore locking each one of the extension arms 12A and 12B in a home position.

As shown in FIGS. 4 and 5, each one of the sleeve bearings 25 is rotationally engaged with the corresponding axle 20 and non-rotatably secured to the corresponding extender bracket 33 with a portion thereof protruding through a hole in the extender bracket 33 and engaged with the corresponding wear spacer 35 and contiguous with corresponding follower 24. Each one of the axles 20 is engaged in free rotational fashion with the corresponding horizontally elongated hole 24A in skating blade 10. It is note worthy to mention that vertical alignment and containment of the skating blade 10 along the horizontal plane is a function of each one of the wear spacers 35 straddling the skating blade 10 in a contiguous and slidable fashion. Specifically, urging upon the vertical face of the skating blade 10, applied by the opposing vertical face of each one of the wear spacers 35, must be predetermined not to be so strong as to cause too much friction between the contiguous surfaces, which would impair lateral movement of the skating blade 10 in the vertical plane during use of the invention. At the same time, the force must not be so weak as to cause wobbling and angular misalignment of the skating blade 10. This may be easily accomplished by predetermination of the cross sectional width of each one of the extender brackets 33 and wear spacers 35 in relation to length of follower 24 and length of each one of the bearing sleeves 25 which, when combined, must be slightly larger than the length of the sum of the cross section respectively. In an alternate embodiment, a pre-fabricated shim of varying thickness (not shown) is sandwiched such between each one of to extender brackets 33 and wear spacers 35.

Figure 7:
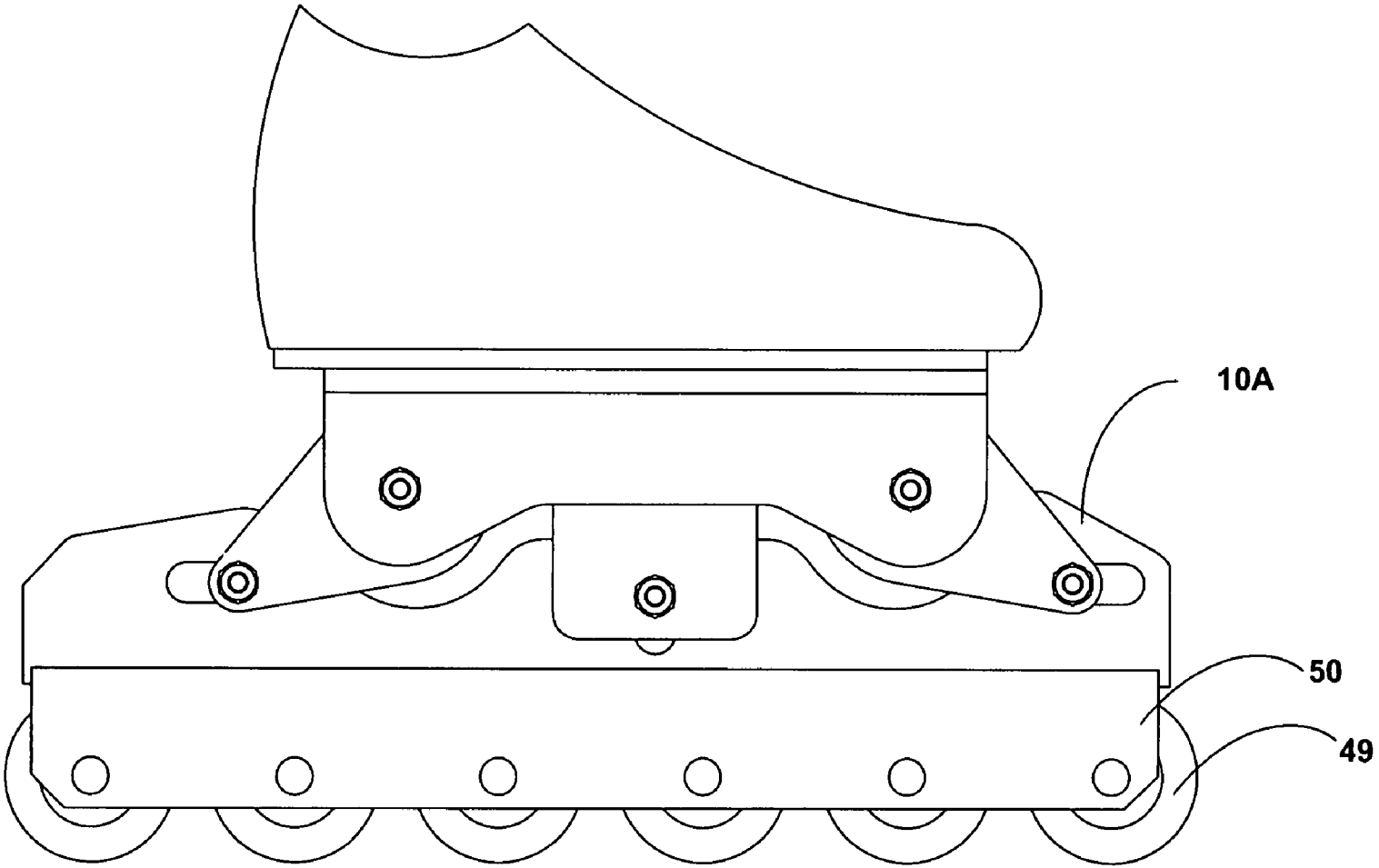
FIG. 7 is a side elevation view of an in-line roller skate embodiment of present invention.

FIG. 7 shows an alternate embodiment of this invention in front elevation view. As described in detail above and referenced in FIGS. 1-6, all elements are identical with exception to a modified skating blade 10A having a lower section thereof which provides an attachment 50 having a plurality of skating wheels 49 in co-linear alignment along a longitudinal centerline of the modified skating blade 10A. Therefore it is contemplated and perceived that a detailed description and labeling of applicable elements for this alternate embodiment is repetitious at best and, for these reasons, has been omitted.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element.

The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An ice skate comprising a platform in a horizontal plane having a foot wear attached to an upper side thereof with a pair of side brackets in a vertical plane secured to the under side of said platform straddling at least one pair of extension arms having a wear plate and said pair of extension arms is pivotally arranged and contained on a center axle along the horizontal plane with said pair of extension arms having an axle secured to a distal end thereof along the horizontal plane with a follower affixed on said axle and each one of said pair of extension arms encircling a one of a pair of elastic elements thereof confined to allow said pair of extension arms to pivot on said center axle having said follower engaged with a skating blade and opposing each other, said side bracket having an extender bracket with a wear plate and an axle along the horizontal plane having said follower affixed to said axle thereof engaging with said skating blade.

2. The apparatus of claim 1 wherein said center axle is secured in non-pivotal fashion to each of said side brackets at opposing ends of said axle.

3. The apparatus of claim 1 wherein each one of said extension arms provides a hub section with said elastic element confined within the hub section thereof, said elastic element comprising a torsion spring having a right angle extension at each one of a pair of opposing terminal ends thereof, with a first one of the pair of opposing terminal ends engaged with a through hole in said hub section and a second one of the pair of opposing terminal ends engaged with a through hole in said side bracket.

4. The apparatus of claim 1 wherein said pivotal containment of each one of said extension arms on said center axle further comprises a plurality of spacer element sized in cross-sectional length to be predetermined and contiguous and slideably engaged with said extension arm and said side bracket.

5. The apparatus of claim 1 wherein said pair of extension arms comprises at least two singular extension arms opposing each other coaxially in mirror image with a wear spacer secured to each one of a pair of opposing faces thereof.

6. The apparatus of claim 1 wherein said follower rotates freely on said axle and is of a predetermined distance between a pair of opposing terminal ends of said axle.

7. The apparatus of claim 1 wherein said follower is engaged with at least two elongated holes in said skating blade.

8. The apparatus of claim 1 wherein said pair of extension arms straddle said skating blade contiguously and slideably at opposite sides thereof with said wear spacers.

9. The apparatus of claim 1 wherein said extender bracket straddles said skating blade contiguously and slideably at opposite sides thereof with said wear spacers.

10. The apparatus of claim 3 wherein said torsion spring comprises a multi coil configuration.

11. The apparatus of claim 3 wherein said right angle extension is in coaxial alignment with a center axis thereof, and at least one said through hole is of elongated configuration in a vertical plane.

12. The apparatus of claim 3 wherein each one of said extension arms has a range of pivotal movement confined by said torsion spring depending on the location of said through hole in said extension arm.

13. The apparatus of claim 7 wherein each one of a forward section and a rearward section of said skating blade provides an elongated hole along a horizontal plane, and a center section of said skating blade provides an elongated hole along a vertical plane.

14. The apparatus of claim 7 wherein said follower is able to travel unrestricted along a plane of elongation within said elongated hole.

15. The apparatus of claim 7 wherein said elongated hole has a predetermined cross-sectional distance between opposing ends thereof along a plane perpendicular to said plane of elongation.

16. The apparatus of claim 14 wherein the distance between the opposing ends of each one of said elongated holes along said plane of elongation is predetermined.

* * * * *